US011454089B2

(12) United States Patent
Nelson, II

(10) Patent No.: US 11,454,089 B2
(45) Date of Patent: Sep. 27, 2022

(54) BALL AND SEAT VALVE ASSEMBLY AND DOWNHOLE PUMP UTILIZING THE VALVE ASSEMBLY

(71) Applicant: Joe A. Nelson, II, Flint, TX (US)

(72) Inventor: Joe A. Nelson, II, Flint, TX (US)

( * ) Notice: Subject to any disclaimer, the term of this patent is extended or adjusted under 35 U.S.C. 154(b) by 112 days.

(21) Appl. No.: 16/873,901

(22) Filed: Aug. 10, 2020

(65) Prior Publication Data

US 2022/0042397 A1 Feb. 10, 2022

(51) Int. Cl.
*E21B 34/08* (2006.01)
*E21B 43/12* (2006.01)

(52) U.S. Cl.
CPC ..... *E21B 34/08* (2013.01); *E21B 43/126* (2013.01); *E21B 2200/04* (2020.05)

(58) Field of Classification Search
CPC ..... E21B 34/08; E21B 43/126
See application file for complete search history.

(56) References Cited

U.S. PATENT DOCUMENTS 2,344,786 A * 3/1944 Patterson ..... F04B 47/00 417/503
5,533,876 A * 7/1996 Nelson, II ..... E21B 31/107 137/512.3
5,628,624 A * 5/1997 Nelson, II ..... E21B 31/107 137/494
5,893,708 A * 4/1999 Nelson, II ..... F04B 7/0073 417/456
5,992,452 A * 11/1999 Nelson, II ..... F04B 47/00 137/539.5
6,007,314 A * 12/1999 Nelson, II ..... F04B 47/02 137/533.15
7,051,813 B2 * 5/2006 Hayes ..... F04B 53/126 166/332.4
9,518,457 B2 * 12/2016 Gronning ..... E21B 43/127

* cited by examiner

*Primary Examiner* — Matthew R Buck

(57) ABSTRACT

Disclosed is a work for oilwell plunger pumping under a packer system used to increase the wear life of API ball and seat valves and of ball and seat valves seat utilizing a piston actuator mechanism to unseat the ball from the seat, which during operation, create turbulent flow within the housing to increase force to move piston actuator like rifle bullet or weighted blow dart in dynamic high velocity high impact in stages to overcome hydraulic head and surface tension between ball and seat. Also disclosed umbrella shaped disks on the piston actuator for increased force to be used in both insert and tubing type down hole plunger oil well pumps. The labyrinth of fluid passages that are rectangular channels not holes help keep ball off its seat for complete down stroke and keep solids in suspension to prevent plugging of API ball in API valve cage. Part of the art is based on "Hydraulic Jump" theory by Leonardo Di Vinci in 1500's where thin film at the surface, greatly increases force due to physical changes to fluid at high speeds hitting objects.

3 Claims, 6 Drawing Sheets

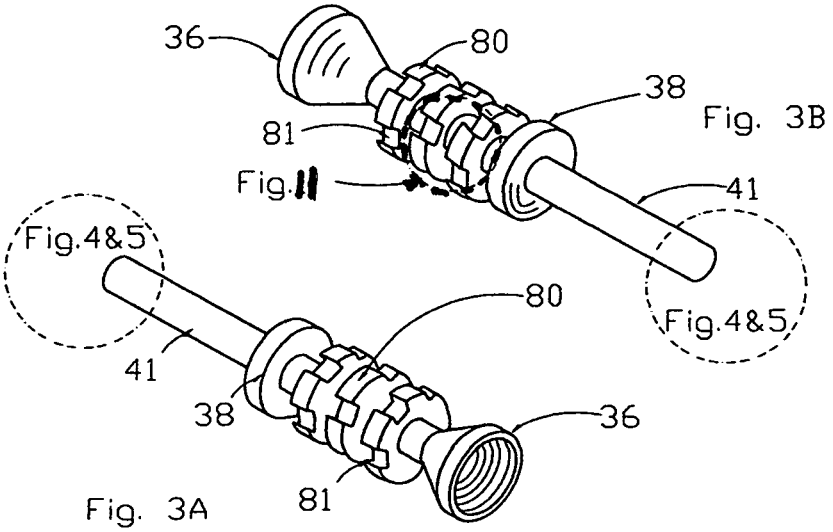
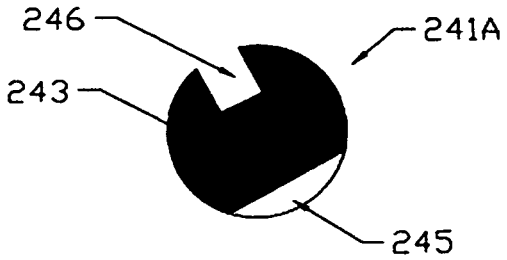
FIG. 4
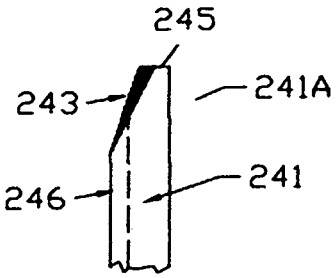
FIG. 5

BALL AND SEAT VALVE ASSEMBLY AND DOWNHOLE PUMP UTILIZING THE VALVE ASSEMBLY

BACKGROUND OF THE INVENTION

1. Field of the Invention

The present invention relates to valves and pumps. In another aspect, the present invention relates to ball and seat valves, and to pumps utilizing said valves. In even another aspect, the present invention relates to ball and seat valves utilizing a piston mechanism to unseat the ball from the seat, and to down hole pumps utilizing said valves. In still another aspect, the present invention relates to ball and seat valves including components to increase their wear life. In yet another aspect, the present invention relates to ball and seat valves including components to create turbulent flow for movement of actuator piston. Also present invention breaks the surface tension between traveling valve ball and seat while overcoming the hydrostatic forces in the tubing above the down hole oil well pump. Fluid flow is through rectangular channels not round holes to reduce flashing.

2. Description of the Related Art

In the production of hydrocarbons from subterranean formations, it is desirable that the pressure of the formation "produce" or force the hydrocarbons to the surface. Unfortunately, sometimes formation pressure may be initially too low to produce the formation, or may decline to that point as hydrocarbons are produced from a formation. Resort must then be made to the use of a pump to produce the formation.

Most commonly in petroleum production technology, producing wells utilize a so called "sucker rod" to lift oil from subterranean formations to the surface of the earth. Sucker rod pumps are generally either a rod insert pump or a tubing pump. Tubing pumps are constructed such that the barrel assembly is an integral part of the tubing string and such that the plunger assembly is part of the rod string. Rod insert pumps, however, are of the stationary barrel traveling plunger type, wherein the barrel assembly is wedged into the seating nipple at the bottom of the tubing, thus providing a seal point.

In general a sucker rod pump is a reciprocating pump which is normally secured to the lowermost end of the sucker rod string, which extends longitudinally through the well bore from a reciprocating device at the surface of the ground. The reciprocating device at the surface is usually a horsehead type apparatus and alternatively raises and lowers a string of sucker rods in the well bore.

The sucker rod pump itself generally includes a housing (called a barrel) through which a piston is reciprocated by the sucker rod linkage. In its simplest form, the pump usually includes a number of ball and seat valves with one such valve in the piston and another at the inlet port of the housing. On the upstroke of the plunger, the ball in the inlet port valve ("standing valve") is drawn away from its seat and the ball of the outlet port valve ("traveling valve") is forced onto its seat to draw fluid from below the seating nipple and into the housing. On the piston's downstroke, the ball in the standing valve is forced into its seat and the ball in the traveling valve moves away from its seat to allow the piston to move downwardly through the fluid contained in the housing. On the subsequent upstroke, the closing of the traveling valve forces the fluid above the piston, out of the housing through the outlet ports and into the tubing above the pump and simultaneously fills the housing below the piston with fluid. Repetition of this cycle eventually fills the tubing string and causes the fluid to flow to the surface.

One problem encountered by sucker rod pumps is caused by the wear of the ball and seat valves. The fluid produced from many geological formations contains minute, abrasive particles, such as sand, which lodge between the ball and seat and wear away the valve components. Over a period of time, the sealing efficiency of the valves is reduced to such an extent that the pump must be removed and repaired or replaced. In some wells, where the production fluid is particularly sandy or corrosive, these pumps must be replaced at frequent intervals. It is, of course, evident that removing and repairing or replacing a pump, and the associated losses of lost production time during the repair or replacement process, can be significant expense factors.

Another problem associated with such conventional ball and valve sub-surface oilfield pumps is generally known as "gas locking". In such pumps, the fluid head pressure in the tubing string is held by the traveling valve, on the upstroke of the piston, and by the lower standing valve on the downstroke of the piston. The down stroke of the traveling valve builds up pressure on the fluid between the traveling valve and the standing valve which causes the traveling valve to open to allow fluid to pass above the traveling valve. However, in a well producing both oil and gas, the chamber between the traveling valve and the standing valve, frequently fills with gas, and due to the compressibility of gas, the downstroke of the traveling valve may not build up sufficient pressure in the chamber below the traveling valve to act upwardly on the ball of the traveling valve to overcome the immense pressure of the fluid column above the traveling valve which acts downwardly on the ball of the traveling valve, resulting in the ball of the traveling valve remaining in the closed seated position during the downstroke. Thus, the gas between the standing valve and the traveling valve merely compresses and expands with each stroke of the pump, producing the operational failure of the pump known as "gas locking". This condition may remedy itself after a short time or may continue indefinitely. The additional problem is the adhesion of the ball to the seat by surface tension created by the oil under great pressure.

Another problem is holes in casing that require a packer to isolate leak where all fluid must go through pump including large volume of gas. Many of these wells are abandoned waiting to be plugged.

Even another problem associated with such conventional ball and valve sub-surface oilfield pumps is generally known as "fluid pounding." This fluid pounding occurs when the pump does not fill completely with liquid during the upstroke, resulting in the formation of a low pressure gas cap in the top of the pump chamber between the traveling valve and the standing valve. During the subsequent downstroke the traveling valve stays closed until it impacts the liquid.

There has been a long felt need to solve the above described problems associated with such conventional ball and valve sub-surface oilfield pumps, and the art is replete with attempts to solve one or more of the above problems.

U.S. Pat. No. 1,585,544, issued May 18, 1926 to Hubbard, discusses the problem of "air hammering", and suggests the use of a rod mounted on the standing valve which impacts the ball of the traveling valve as the traveling valve is moved toward the standing valve. However, given the expansion and contraction of the sucker rods, the traveling valve may not reach the rod, or may extend past the rod, damaging the valve.

U.S. Pat. No. 4,691,735, issued Sep. 8, 1987 to Horton, discloses a traveling valve for an oil well pump, which includes a piston below the traveling valve which lifts the traveling valve ball above the traveling valve seat. On the downstroke, pressure builds up between the standing valve and the piston, to force the piston upward to lift the ball. However, since the piston cross-sectional area affected by the pressure between the standing valve and the piston is equal to the cross-sectional area of the traveling valve seat, no mechanical advantage is provided by the arrangement of Horton. Thus, Horton suffers from "gas locking" to the same extent as conventional traveling valves. Additionally, the Horton traveling valve and the rod assembly are not mounted below the bottom of the plunger, and thus must be made of materials strong enough to withstand the rigors of operation of the pump.

U.S. Pat. No. 4,781,547, issued Nov. 1, 1988 to Madden, discloses a pushrod assembly mounted below the traveling valve, which pushrod is alternatively moved from an extended into a retracted position each upstroke and downstroke of the pump. The free terminal end of the pushrod is arranged to engage the traveling valve ball as the pump commences the downstroke. However, since the bottom of the pushrod includes several channels, pressure does not build up between the pushrod and the standing valve during the downstroke. Rather, during the downstroke liquid is forced through the channels in the bottom of the pushrod. Movement of the pushrod is affected by inertia, pressure differential of the liquid flow through the channels, and friction between the pushrod and the pump barrel.

U.S. Pat. No. 5,533,876 dated Jul. 1, 1996, U.S. Pat. No. 5,628,624 issued May 1, 1997, U.S. Pat. No. 5,893,708 issued Apr. 13, 1999, U.S. Pat. No. 5,992,452 issued Nov. 30, 1999, U.S. Pat. No. 6,007,314 issued Dec. 28, 1999 to Nelson used piston actuator to move the ball. Currently there are issues for pumping under a packer that forces all fluid to go through the pump. Increased force is required to hold the valve open due to large amount of gas being pumped. There is a need to pump gas as well as other fluids when working under a packer.

Therefore, there is a need in the art for an improved down hole reciprocating pump.

These and other needs in the art will become apparent to those of skill in the art upon review of this patent specification, claims and drawings.

SUMMARY OF THE INVENTION

It is an object of the present invention to provide an improved downhole reciprocating pump.

It is another object of the present invention to provide for an improved apparatus for reducing the wear of a downhole reciprocating pump by keeping sand and other debris from collecting on and wearing pump components by flowing through pump on every stroke.

These and other objects of the present invention will become apparent to those of skill in the art upon review of this patent specification, claims and drawings.

According to one embodiment of the present invention there is provided a ball and seat valve assembly which generally includes a hollow tubular member holding a ball and valve. Mounted within the tubular member below the valve seat is a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball.

According to another embodiment of the present invention there is provided a ball and seat assembly which generally includes a ball and seat valve. Mounted to the bottom of the valve is a tubular member having therein a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball. Seal area wear surfaces are treated for low friction and wear prevention.

According to even another embodiment of the present invention there is provided a ball and seat assembly which generally includes a first tubular member containing a ball and seat valve. Mounted to the bottom of the first tubular member is a second tubular member having therein a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball. Umbrella shaped discs on the piston actuator adds to force of piston acting on the ball and keeps solids in suspension to prevent ball from plugging in the valve cage.

According to still another embodiment of the present invention there is provided a pump assembly which generally includes a pump housing with a plunger positioned therein. Affixed to the plunger is a traveling ball and seat valve. Mounted to the bottom of barrel is a tubular member having therein a piston with an actuator for engaging the seated ball. Mechanical advantage is provided either by providing a sealing area of the piston that is greater than the sealing area of the seat valve and/or by providing an actuator suitable to strike the seated ball asymmetrically with respect to the vertical axis through the center line of the ball. The piston actuator tip is sloped in two directions acting like a screw to increase force to open ball from seat.

According to yet another embodiment of the present invention there is provided a ball and valve seat assembly. The assembly generally includes a hollow tubular member having an interior wall defining an internal cross-sectional area. A valve seat is mounted within the tubular member, having a seating passage with a seating cross-sectional area and a ball positioned above the valve seat. A piston is moveably mounted withing the tubular member below the valve seat. The piston includes an actuator for engaging the ball through the passage and a sealing member with a sealing area for sealing the tubular member below the valve seat across the entire internal cross-sectional area of the tubular member. The grove in the piston actuator tip aids the breaking of surface tension between the ball and seat.

According to even yet another embodiment of the present invention there is provided a ball and seat valve assembly which generally includes a hollow tubular member having an interior wall defining an internal cross-sectional area. A valve seat is mounted within the tubular member, having a seating passage with a seating cross-sectional area and a ball positioned within the tubular member above the valve seat. A piston is moveably mounted withing the tubular member below the valve seat. The piston includes an actuator for engaging the ball through the passage while the ball is seated on the seat and a sealing member with a sealing area for sealing the tubular member below the valve seat across the entire internal cross-sectional area of the tubular member. The assembly also includes at least one turbulent flow disk positioned within the tubular member below the ball and valve seat substantially spanning the cross-sectional area with the flow disk defining rectangular fluid passages providing fluid communication between the internal cross-sectional area above the flow disk and the internal cross-sectional area below the flow disk plus umbrella shapes with flow areas around edges.

According to still yet another embodiment of the present invention there is provided a ball and seat valve assembly which generally includes a hollow tubular member having an interior wall defining an internal cross-sectional area. A valve seat is mounted within the tubular member, having a seating passage with a seating cross-sectional area and a ball positioned within the tubular member above the valve seat. A piston is moveably mounted withing the tubular member below the valve seat. The piston includes an actuator for engaging the ball through the passage while the ball is seated on the seat and a sealing member with a sealing area for sealing the tubular member below the valve seat across the entire internal cross-sectional area of the tubular member. Flow areas form a labyrinth of flow passages for fluid flow and transmission of force to move piston actuator upward to strike ball.

According to another embodiment of the present invention is when plunger starts in down stroke flow hits curved bottom of internal movable piston actuator metal part as it move from first valve fluid enters open area and hit umbrella shaped discs and through flow areas on the edges that are spaced around circumference up to hit second valve flow around umbrella discs and pushes metal plunger object with tip sloped in two directions acting like screw to hit ball at offset angle with channel cut breaking surface tension between ball and seat also overcoming hydrostatic head to allow fluid to flow into tubing without gas lock or fluid pound keeping ball off of seat for complete down stroke. Pressure hits top disc valve in staged fashion to ad to force to move actuator piston upward to unseat the ball from the seat. The actuator piston moves in a dynamic staged fashion for impact to ball to move ball from seat In the up stroke hydrostatic forces ball back to seat and piston actuator to seat.

BRIEF DESCRIPTION OF THE DRAWINGS

FIG. 1B also shows location of cross sections 3-3, 11-11, 12-12

FIG. 3 B is enlarged oblique view of piston actuator showing disc from top showing flow areas 81

FIG. 4 is view of top of piston actuator tip 241A showing slopes 243 and 245 and grove 246

FIG. 5 is enlarged side view of piston actuator tip 241A showing tip showing slopes 243 and 245 and grove 246

DETAILED DESCRIPTION OF THE INVENTION

Referring now to the figures the present invention will be shown and described in detail. Fluid is defined as gas, water, oil or mixture thereof.

Figure 1A:
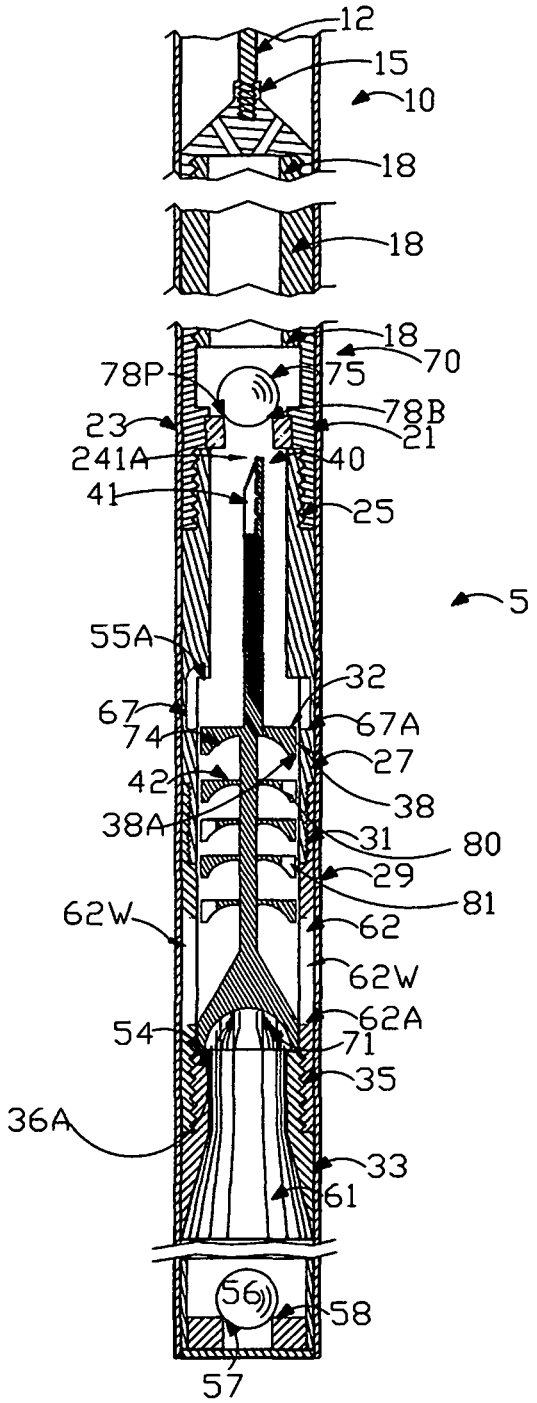
FIGS. 1A, and 1B are cross-sectional views of reciprocating fluid pump 5 of the present invention showing piston 41 in a lower and in an upper position, respectively. Also showing umbrella shaped discs.
Figure 1B:
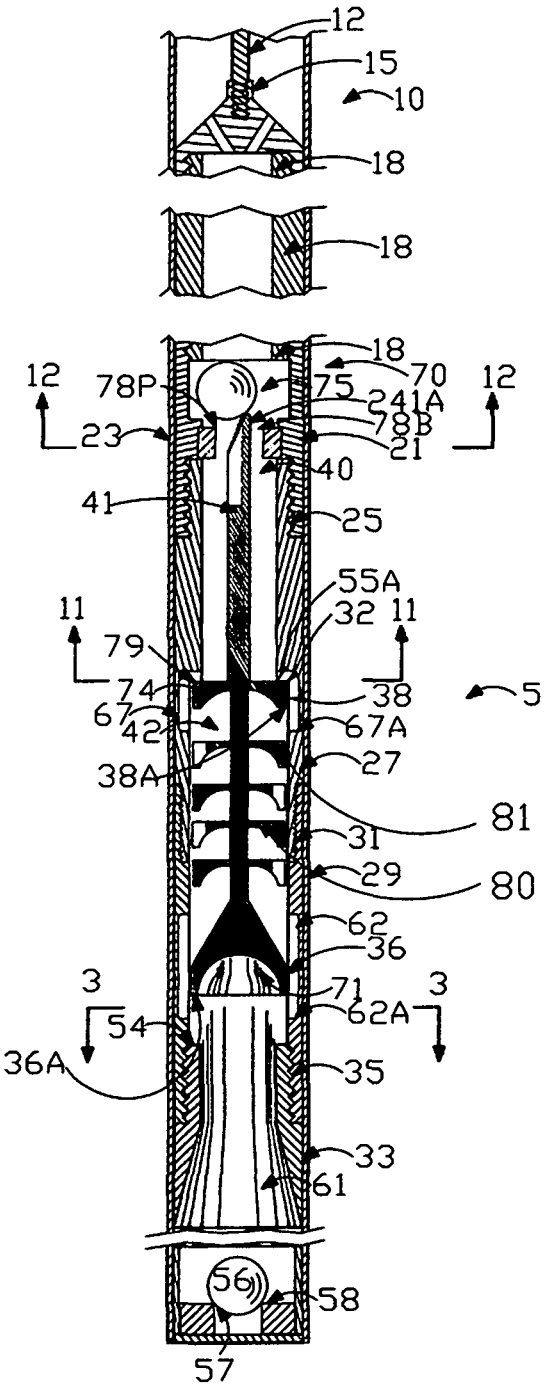

FIGS. 1A and 1B are cross-sectional views of reciprocating fluid pump 10 of the present invention showing piston 40 in a lower and in an upper position, respectively.

In general, sucker rod 322 connects to and actuates pump pull rod 12. Sucker rod 322 is actuated from the surface by any of the well known means, usually a "rocking horse" type pump jack unit . . . .

Threaded connection 25 joins traveling valve cage 21 with tubular housing 27, which extends downwardly to lower housing 29 by threaded connector 31. Housing 29 in turn extends downwardly and connects to housing 33 through threaded connector 35. It is to be understood that housings 27, 29 and 33 form hollow tubular housing assembly 5 which is adapted for attachment to the traveling valve 70.

At the bottom of barrel 23 is positioned conventional standing valve 58, including conventional seat 57 and ball 56.

Piston 40 is positioned within tubular assembly 5 within pump 10 as shown, and includes actuator 241 having engaging end 241A, lower sealing member 36, upper sealing member 38, piston body 42, umbrella shaped discs 80 are attached to piston body 40. Flow area 81 is on circumference of umbrella shaped discs 80.

The vertical motion of piston 40 in housing assembly 5 within pump 10 is restricted at its uppermost point by the engagement of upper stops 55 of housing 27 and shoulders 32 of upper sealing member 38 as shown in FIG. 1B, and at its lowermost point by engagement of lower stops 54 of housing 33 with bottom shoulder 36A of lower sealing member 36 as shown in FIG. 1A.

Fluid flow around lower sealing member 36 through channels 62 in housing 29 occurs once bottom shoulder 36A clears lower end 62A of channels 62 in staged fashion.

Generally, channels 62 are not continuously connected around the perimeter of housing 29, but rather are spaced by guides formed in the walls of housing 29. It is to be understood that any number of channels 62 may be utilize, as long as at least one channel 62 is provided. Thus, when bottom shoulder 36A is above lower channel end 62A, lower sealing member 36 is positioned in lower housing 29 by the guides formed in the walls of housing 29.

Fluid flow around sealing member 36 is prevented when bottom shoulder member 36A is positioned below lower channel member 62A. Sealing member 36 will form a seal with lower housing 29 such that pressure can be held by sealing member 36. Additional optional sealing can be provided by utilizing a sealing seat against which sealing member 36 will abut. In the embodiment shown in FIG. 1A, lower stop 54 is additionally a seal seat for sealing member 36. Thus, sealing is provided by sealing member 36 circumferentially abutting housing 29, and by the bottom of sealing member 36 abutting lower stop or seat 54.

Lower sealing member 36 includes sealing area 71 which may be any shape suitable to seal the internal cross-section of housing 29 below channel end 62A. In the embodiment shown, sealing area 71 is a concave shape, although any suitable shape may be utilized.

It is to be understood that in the event of fluid leakage past or failure of traveling valve 70, sealing member 36 may be designed suitable to provide backup sealing.

Fluid flow around upper sealing member 38 through channels 67 in housing 27 occurs once bottom shoulder 38A clears lower end 67A of channels 67. Generally, channels 67 are not continuously connected around the perimeter of housing 27, but rather are spaced by guides formed in the walls of housing 27. It is to be understood that any number of channels 67 may be utilized, as long as at least one channel 67 is provided. Thus, when bottom shoulder 38A is above lower channel end 67A, lower sealing member 38 is positioned in housing 27 by the guides formed in the walls of housing 27.

With piston 40 at its uppermost point, with upper stops 55 of housing 27 arid shoulders 32 of upper sealing member 38 in engagement, fluid flow will still occur around sealing member 38. Flow area 79 extends downwardly along the side of sealing member 38 to form a liquid passage with channel 67. Even when shoulder 32 is abutted against stop 55 this flow area 79 is in liquid communication with channel 67, and thus allows for passage of fluid from channel 67 and past sealing member 38 through flow area 79.

Fluid flow around sealing member 38 is prevented when bottom shoulder member 38A is positioned below lower channel member 67A. Sealing member 38 will form a seal with housing 27 such that pressure can be held by sealing member 38.

Sealing member 38 includes sealing area 74 which may be any shape suitable to seal the internal cross-section of housing 27 below channel end 67A. In the embodiment shown, sealing area 74 is a concave shape, although any suitable shape may be utilized.

The embodiment of the present invention is illustrated with two sealing members 36 and 38. It is to be understood that at the very least, one sealing member must be utilized, with additional sealing members being optional. However, one problem that must be addressed is the orientation of the piston 40. While one sealing member could be modified to keep piston 40 in its proper vertical alignment, it is preferred to utilize either a second sealing member, or a rod guide to keep piston 40 aligned properly.

It is important that the sealing area of the sealing member that holds pressure against standing valve 58, which in the embodiment shown is sealing area 71 of member 36 initially, and subsequently sealing area 74 of member 38, have a sealing area that is greater than the cross-sectional area of valve seat passage 78B. Preferably, the sealing area of sealing member 36 and/or 38 will be at least 1.1 times greater than the cross-sectional area of valve seat passage 78B, more preferably at least 2 times greater, even more preferably at least 5 times greater, even still more preferably at least 6 times greater, even yet more preferably at least 9 times greater, and most preferably at least 12 times greater. Also umbrella shaped discs to provide additional force for actuator to keep valve open through complete down stroke Operation of pump 10 is as follows. In the upstroke, sucker rod 322 driven by a surface pumping unit moves plunger 18, traveling cage 21 and tubular assembly 5 upward. This motion closes traveling valve 70, forces piston 40 into its downward position with shoulder 36A abutted against stop 54, and opens standing valve 58 and pulls liquid into conical area 61 of pump 10*f*. Umbrella shaped flow disks create turbulence in the pump to keep sand and other particles, in suspension moving into tubing above thereby keeping the solids away from the wear parts of pump 10 such as piston 40, actuator 241, ball 75 and seat 78.

On the down stroke, plunger 18, traveling cage 21 and tubular assembly 5 are driven downward thereby closing standing valve 58 and compressing the fluid drawn into area 61 between lower sealing member 36 and the now closed standing valve 58, see FIG. 1A. With the continuing downstroke, this pressure builds and acts upon sealing surface 71 of piston 40, ultimately driving it upward in staged movement. Once shoulder 36A clears channel bottom 62A liquid flow bypasses sealing member 36 by passing through channel 62. With piston 40 in this intermediate position, pressure is now being held by sealing member 38. With the continuing down stroke, this pressure builds and acts upon sealing surface 74 of piston 40, ultimately driving it upward. Once shoulder 38A clears channel bottom 67A, liquid flow goes around sealing member 38 through channels 67, and on through traveling valve 70. Piston 40 is ultimately driven to its upmost position with shoulder 32 of member 38 abutting stop 55. Adding to this movement with flow around outer edge slots are the umbrella shaped discs. At this point, fluid will continue to bypass sealing members 36 and 38 through channels 62 and 67, respectively, and on through traveling valve 70.

Although actuator 241 is shown in the figures to strike traveling valve ball 75 asymmetrically with respect to its vertical axis, it is understood that actuator 241 may be configured to strike seated traveling valve ball 75 near its vertical center axis as it is in its seated position. Preferably, actuator 241 strikes ball 75 such as to allow it to pivot on seat 78 at pivot point 78P. More specifically, actuator 241 will strike traveling valve ball 75 asymmetrically with respect to its vertical center axis as it is in its seated position. The asymmetrical striking of traveling valve ball 75 could be achieved by angling member 241 or by offsetting member 241 from the vertical center line of pump 10.

Figure 2:
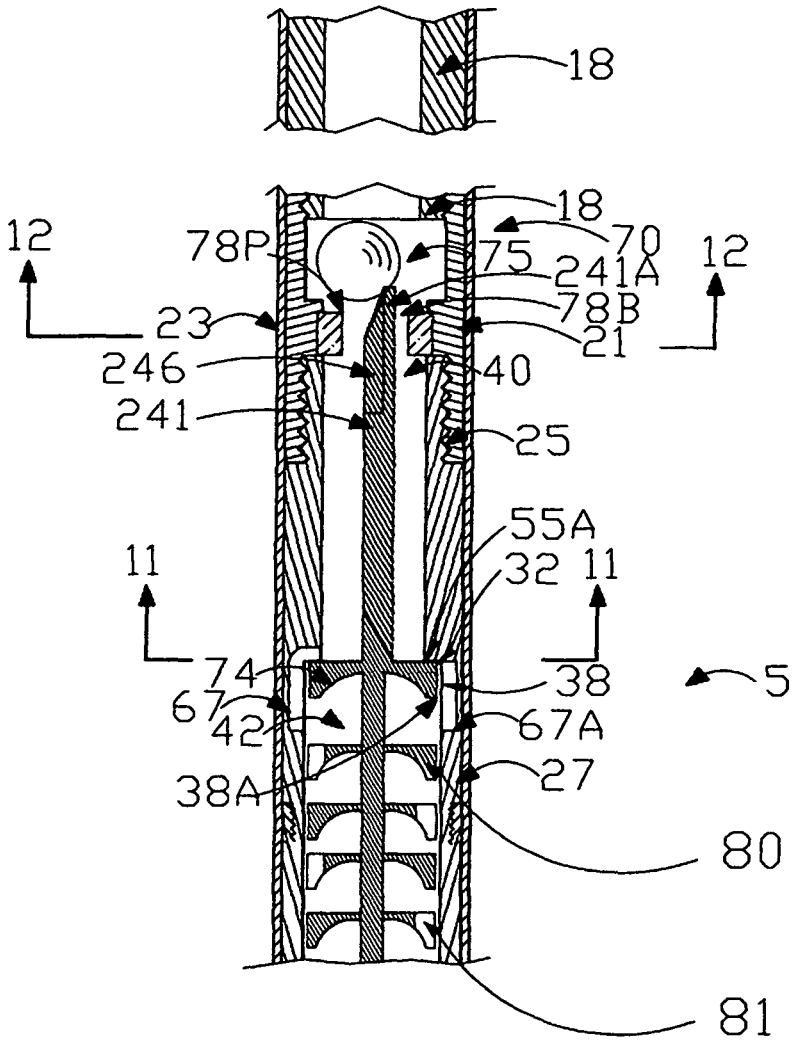
FIG. 2 is an enlarged view of tubular assembly 5 illustrating piston actuator 241 and flow areas around disc and flow areas around umbrella shaped discs. Cross section 11-11, and 12-12 locations are also shown. Grove 246 at top of 241 is also shown FIG. 3 A is enlarged oblique view of piston actuator showing disc from bottom showing flow areas 81.
Figure 6:
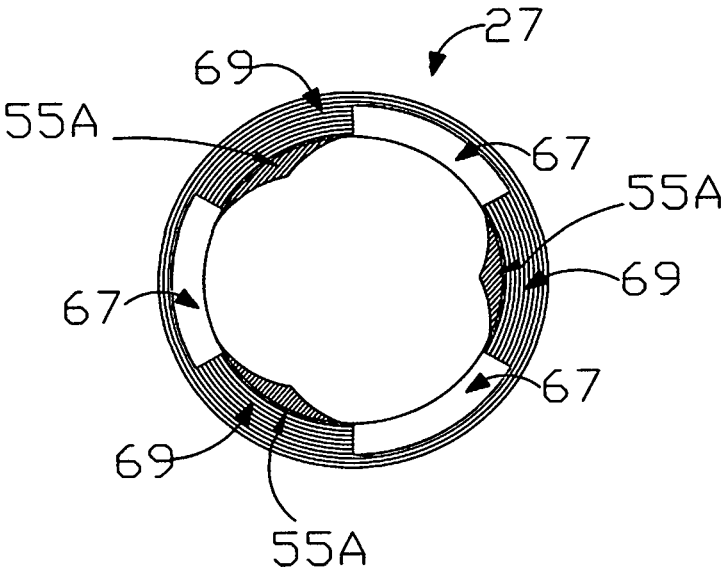
FIG. 6 is a horizontal cross-sectional view of flow areas and stops around top piston actuator housing 69 taken along line 11-11 of FIG. 1B
Figure 7:
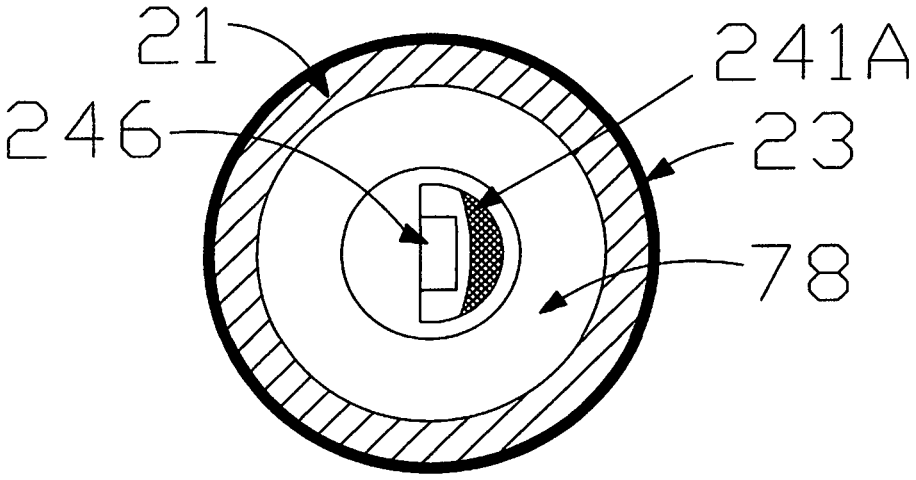
FIG. 7 is a vertical cross-sectional view showing seat, piston actuator tip 241A, barrel, and flow area of piston actuator housing taken along line 12-12 of FIG. 1B
Figure 8:
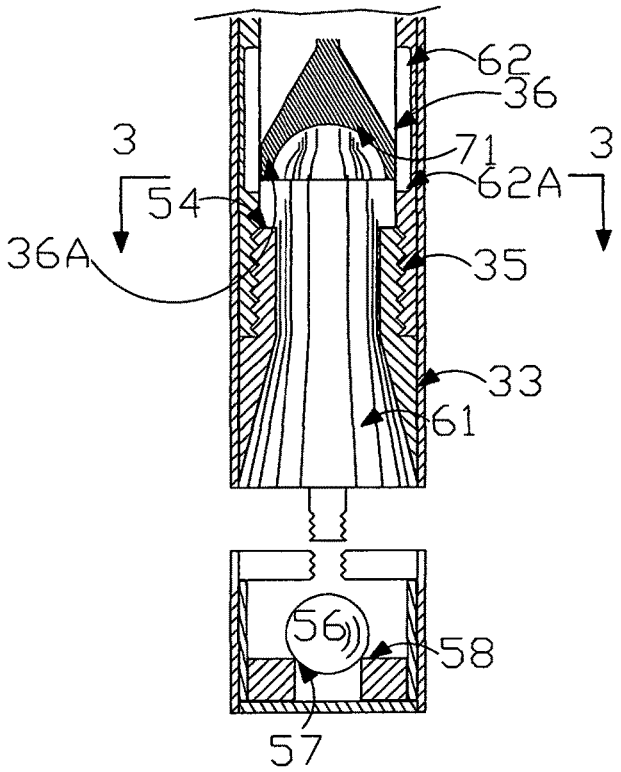
FIG. 8 is a horizontal cross-sectional view of a second embodiment showing tubing pump piston actuator with bottom threads to attach standing valve puller where pump barrel is actually the bottom section of the tubing string. This also shows opening of bottom valve 32 opening to allow flow to umbrella discs through flow area 62 and upper valve 38 in staged fashion.
Figure 9:
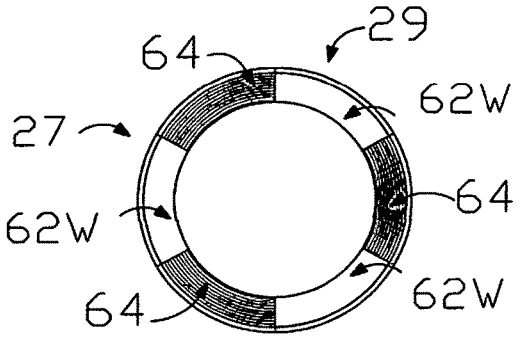
FIG. 9 is a horizontal view showing flow areas 62*w* and actuator guides 64 taken along line 3-3 of FIG. 1B.
Figure 10:
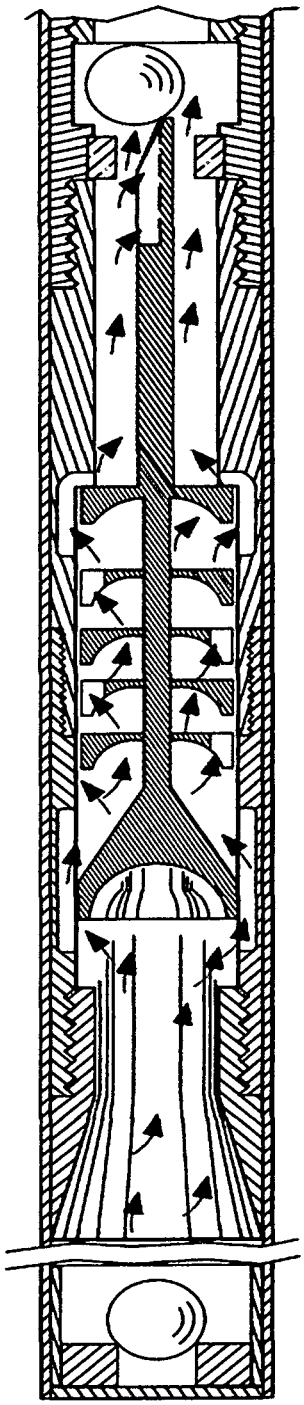
FIG. 10 is FIG. 1B showing fluid flow tracking through passages in down stroke of plunger.
Figure 11:
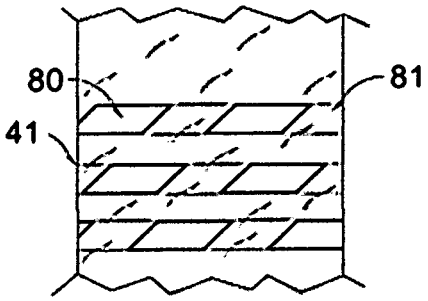
FIG. 11 is enlarged view of umbrella flow areas 81 on piston shaft 41.

While not wishing to be limited to theory, the inventor believes that this asymmetrical striking will create a moment that will allow the ball 75 to pivot on its seat 78 at point 78P shown in FIG. 2. The inventor believes that this pivoting or prying action provides a mechanical advantage over merely forcing ball 75 in the vertical direction that will help to overcome the liquid column pressure acting downwardly on ball 75. The edge of 241 is beveled in two directions allowing actuator work like a screw for additional force to open ball. A vertical channel in tip aids in breaking surface tension between ball and seat.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled the art to which this invention pertains.

I claim:

1. A valve assembly for installation inside a pump barrel in a downhole sucker rod plunger pump in oil and gas wells, the valve assembly comprising: (a) a hollow tubular member with threads on top to screw on to a plunger valve cage that is to hold a ball and a valve seat in place having an interior wall defining an internal cross-sectional area; (b) the valve seat mounted within the tubular member, having a seating passage with a seating cross-sectional area and flow passages in the circumference of the tubular member; (c) the ball positioned within the tubular member and above the valve seat in the plunger valve cage with screwed connection; (d) a piston actuator with a plurality of umbrella disks mounted within the tubular member below the valve seat comprising an actuator for engaging the ball through the passage while the ball is seated on the valve seat and comprising a sealing member with a sealing area for sealing the tubular member below the valve seat across the entire internal cross-sectional area of the tubular member; and wherein the valve seat is closed by the ball being seated on the valve seat, and opened by an increase in pressure from below unseating the ball from the valve seat; (e) the piston actuator with the plurality of umbrella disks with flow areas on circumference to add force to move the ball off the valve seat and remain open during entire downstroke and a piston actuator tip is beveled in 2 directions to act like screw adding force to open ball from the seat working to move the ball off the seat; (f) the piston actuator tip that holds the ball off the seat for complete downstroke of pump plunger with a bottom stop and a top stop; (g) the piston actuator moving in staged movement from one flow area to the next flow area in the flow passage areas in the circumference of the tubular member; and (h) the piston actuator that hits the ball at high velocity to impact and open the ball from the seat and allows fluid flow to tubing above.

2. The valve assembly of claim 1 further comprising: (a) the hollow tubular member having the interior wall defining the internal cross-sectional area with guides to keep the piston actuator straight and balance forces for striking the ball from the seat; (b) the ball positioned within the tubular member and above the valve seat is protected from damage by particulate matter by flushing flow on each stroke; (c) the piston actuator is heat treated for wear while engaging the ball through the passage while the ball is seated on the seat and supported by the tubular member walls for control of the horizontal forces when striking the ball; (d) the plurality of umbrella disks are a plurality of turbulent flow disks positioned within the tubular member below the ball and the valve seat and below the sealing member substantially spanning the cross-sectional area with the flow disk defining fluid passages providing fluid communication between the internal cross-sectional area above the flow disk and the internal cross-sectional area below the flow disk; wherein the valve seat is closed by the ball being seated on the valve seat, and opened by an increase in pressure from below that creates force from high velocity fluid hitting the umbrella disks below the upper flow disc unseating the ball from the valve seat; (e) the piston actuator with the plurality of turbulent flow disks positioned within the tubular member below the ball and the valve seat with flow disk areas defining fluid passages around outer diameter of the discs and the piston actuator providing fluid communication between the internal cross-sectional area above the flow disks and the internal cross sectional area below the flow disks; and (f) an actuator guide treated for wear and friction defining an actuator passage for receiving the piston actuator positioned within the tubular member below the valve seat and positioned such the actuator is within the hollow tubular member.

3. The valve assembly of claim 2 comprising: (a) the plurality of turbulent flow disks is umbrella shaped with rectangular flow areas arranged on edges for open flow through assembly to the tubing above pump; (b) at least one turbulent flow disk further comprises at least one flow vane to aid in the production of turbulent flow to keep particulate matter flowing up to the tubing above; (c) the ball positioned within the tubular member and above the valve seat is kept clean due to the opening by each stroke of the plunger; (d) a system positioned within the tubular member for keeping particulate matter in suspension; (e) a main body positioned within the tubular member above the ball and the valve seat substantially spanning the tubular member cross-sectional area with the main body defining fluid passages providing fluid communication between the internal cross-sectional area above the main body and below the main body; (f) threads on bottom of the tubular member for attachment of a retrieval tool to retrieve standing valve in a tubing pump; (g) the piston actuator with flow channel for the tip that breaks surface tension between the ball and the seat; (h) the piston actuator tip that stops horizontal spin of the ball to reduce wear of the ball and the seat; and (i) a valve system that contains at least 2 stages for the piston actuator movement and flow to the tubing above.

* * * * *